US007296631B2

(12) United States Patent
McGuire et al.

(10) Patent No.: US 7,296,631 B2
(45) Date of Patent: Nov. 20, 2007

(54) SYSTEM AND METHOD FOR LOW-PRESSURE WELL COMPLETION

(75) Inventors: Bob McGuire, Oklahoma City, OK (US); L. Murray Dallas, Fairview, TX (US)

(73) Assignee: Stinger Wellhead Protection, Inc., Oklahoma City, OK (US)

( * ) Notice: Subject to any disclaimer, the term of this patent is extended or adjusted under 35 U.S.C. 154(b) by 0 days.

(21) Appl. No.: 11/701,810

(22) Filed: Feb. 2, 2007

(65) Prior Publication Data

US 2007/0158077 A1 Jul. 12, 2007

Related U.S. Application Data

(63) Continuation of application No. 10/812,446, filed on Mar. 29, 2004, now abandoned.

(51) Int. Cl.
*E21B 33/04* (2006.01)

(52) U.S. Cl. ..... 166/379; 166/89.3; 166/85.4; 166/88.1; 166/89.1; 166/75.13

(58) Field of Classification Search ..... 166/85.4, 166/88.1, 89.1, 89.3, 88.4, 75.13, 75.14, 166/368, 379

See application file for complete search history.

(56) References Cited

U.S. PATENT DOCUMENTS

| | | | |
|---|---|---|---|
| 1,988,442 | A | 1/1935 | Begg |
| 2,205,119 | A | 6/1940 | Hall et al. |
| 3,561,531 | A | 2/1971 | Miller |
| 4,189,003 | A | 2/1980 | James et al. |
| 4,353,420 | A | 10/1982 | Miller |
| 5,540,282 | A | 7/1996 | Dallas |
| 5,605,194 | A | 2/1997 | Smith |
| 5,615,739 | A | 4/1997 | Dallas |
| 6,220,363 | B1 | 4/2001 | Dallas |
| 6,289,993 | B1 | 9/2001 | Dallas |
| 6,364,024 | B1 | 4/2002 | Dallas |
| 6,601,648 | B2 | 8/2003 | Ebinger |
| 6,626,245 | B1 | 9/2003 | Dallas |
| 6,817,421 | B2 | 11/2004 | Dallas |
| 6,817,423 | B2 | 11/2004 | Dallas |
| 6,827,147 | B2 | 12/2004 | Dallas |
| 2004/0231856 | A1 | 11/2004 | Dallas et al. |
| 2004/0262012 | A1 | 12/2004 | McGuire et al. |
| 2005/0006103 | A1 | 1/2005 | McGuire et al. |
| 2005/0051362 | A1 | 3/2005 | McGuire et al. |
| 2005/0082066 | A1 | 4/2005 | McGuire et al. |
| 2005/0082829 | A1 | 4/2005 | Dallas |
| 2005/0199389 | A1 | 9/2005 | Dallas et al. |

*Primary Examiner*—David Bagnell
*Assistant Examiner*—Daniel P Stephenson
(74) *Attorney, Agent, or Firm*—Nelson Mullins Riley & Scarborough, LLP

(57) ABSTRACT

A low-pressure wellhead system with tubular heads and mandrels secured independently using threaded unions. A casing mandrel is secured to a wellhead by a first threaded union. Likewise, a tubing head spool is secured to the casing mandrel using a threaded union. A tubing hanger is also secured to the tubing head spool using a threaded union. An adapter flange may also be secured to the tubing hanger by a threaded union. Because this low-pressure wellhead is faster and easier to assemble and provides full bore access, there is less rig downtime, thus rendering the well completion process faster and more economical.

24 Claims, 16 Drawing Sheets

SYSTEM AND METHOD FOR LOW-PRESSURE WELL COMPLETION

CROSS-REFERENCE TO RELATED APPLICATIONS

This is a continuation of U.S. patent application Ser. No. 10/812,446 filed Mar. 29, 2004, now abandoned the entire disclosure of which is incorporated by reference herein.

MICROFICHE APPENDIX

Not Applicable.

TECHNICAL FIELD

The present invention relates generally to wellhead systems and, in particular, to a low-pressure wellhead system and a method for completing low-pressure wells.

BACKGROUND OF THE INVENTION

Independent screwed wellheads are well known in the art. The American Petroleum Institute (API) classifies a wellhead as an "independent screwed wellhead" if it possesses the features set out in API Specification 6A as described in U.S. Pat. No. 5,605,194 (Smith) entitled Independent Screwed Wellhead with High Pressure Capability and Method.

The independent screwed wellhead has independently secured heads for each tubular string supported in the well bore. Each head is said to be "independently" secured to a respective tubular string because it is not directly flanged or similarly affixed to the casing head. Independent screwed wellheads are widely used for production from low-pressure production zones because they are economical to construct and maintain.

While independent screwed wellheads have gained widespread acceptance in low-pressure applications, the ever-increasing demands for low-cost petroleum products mean that oil and gas companies must find innovative ways of further reducing exploration and extraction costs.

It is therefore highly desirable to provide a simple, cost-effective wellhead system and completion method which minimize drilling and completion expenses, thereby rendering the extraction of subterranean hydrocarbons more economical.

SUMMARY OF THE INVENTION

It is therefore an object of this invention to provide a wellhead system for facilitating the operations of drilling, completing and extracting subterranean hydrocarbons from a low-pressure well. The system includes a plurality of tubular heads independently secured by threaded unions, each tubular head supporting a mandrel for suspending a tubular string in the well. Each mandrel is secured to the tubular head by a threaded union.

The invention also provides a low-pressure wellhead system including an independent screwed wellhead having independently secured tubular heads for supporting respective tubular strings in a well bore; and a plurality of threadedly secured mandrels supported by the tubular heads, the mandrel securing and suspending the tubular strings in the well bore.

The invention further provides a method of completing a low-pressure wellhead. The method includes steps of: securing a first mandrel to a first tubular head using a first threaded union, the first tubular head supporting a first tubular string in the well, and the first mandrel supporting a second tubular string in the well; securing a second tubular head to the first mandrel using a second threaded union; and securing a second mandrel to the second tubular head using a third threaded union, the second mandrel supporting a third tubular string in the well.

The invention further provides a method of completing a low-pressure well after a conductor assembly has been installed in the ground above a subterranean hydrocarbon formation, the method including the steps of landing a wellhead on the conductor assembly, the wellhead securing and suspending a surface casing in the well; securing a casing mandrel to the wellhead using a first threaded union, the casing mandrel securing and suspending a production casing in the well; securing a tubing head spool to the casing mandrel using a second threaded union; and securing a tubing hanger to the tubing head spool using a third threaded union, the tubing hanger securing and suspending a production tubing in the well.

The invention further provides a method of installing and completing a low-pressure wellhead system for the extraction of hydrocarbons from a subterranean hydrocarbon formation, the method including the steps of digging the ground above the subterranean hydrocarbon formation to accommodate a conductor; installing a conductor window on the conductor; running surface casing until a wellhead is seated above the conductor; cementing the surface casing in place; removing the conductor window to expose the wellhead; mounting a blowout preventer and drilling flange to the wellhead using a first threaded union; inserting a test plug into the wellhead system for testing the pressure-integrity of the wellhead system; removing the test plug when the testing of the pressure-integrity of the wellhead is complete; installing a wear bushing in the drilling flange; drilling a bore to accommodate a production casing; running the production casing until a casing mandrel is seated in a casing bowl of the wellhead; cementing in the production casing; removing the blowout preventer and drilling flange; securing the casing mandrel to the wellhead using a second threaded union; securing a tubing head spool to the casing mandrel using a third threaded union; running a production tubing until a tubing hanger is seated in the tubing head spool; and securing the tubing hanger to the tubing head spool using a fourth threaded union.

By providing threaded unions for each of the tubular heads and mandrels in the wellhead system, the well is easier and quicker to complete. Rig downtime is minimized and thus the extraction of hydrocarbons from the well is more economical.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF PREFERRED EMBODIMENTS

For the purposes of this specification, the expressions "wellhead system", "tubular head", "tubular string", "mandrel", and "threaded union" shall be construed in accordance with the definitions set forth in this paragraph. The expression "wellhead system" means a wellhead (also known as a "casing head") mounted atop a conductor assembly which is dug into the ground and which has, optionally mounted thereto, various Christmas tree equipment (for example, casing head housings, casing and tubing head spools, mandrels, hangers, connectors, and fittings). The wellhead system may also be referred to as a "stack" or as a "wellhead-stack assembly". The expression "tubular head" means a wellhead body used to support a mandrel such as a tubing head spool or a wellhead (also known as a casing head). The expression "tubular string" means any casing or tubing, such as surface casing, production casing or production tubing. The expression "mandrel" means any generally annular mandrel body such as a production casing mandrel (hereinafter the "casing mandrel") or a tubing hanger (also known as a tubing mandrel or production tubing mandrel). The expression "threaded union" means any threaded connection such as a nut, sometimes also referred to as a lockdown nut or retaining nut, including wing-nuts, spanner nuts, and hammer unions.

Prior to boring a hole into the ground for the extraction of subterranean hydrocarbons such as oil or natural gas, it is first necessary to "build the location" which involves removing soil, sand, clay or gravel. Once the location is "built", the next step is to "dig the cellar" which entails digging down approximately 40-60 feet, depending on bedrock conditions. The "cellar" is also known colloquially by persons skilled in the art as the "rat hole".

Figure 1:
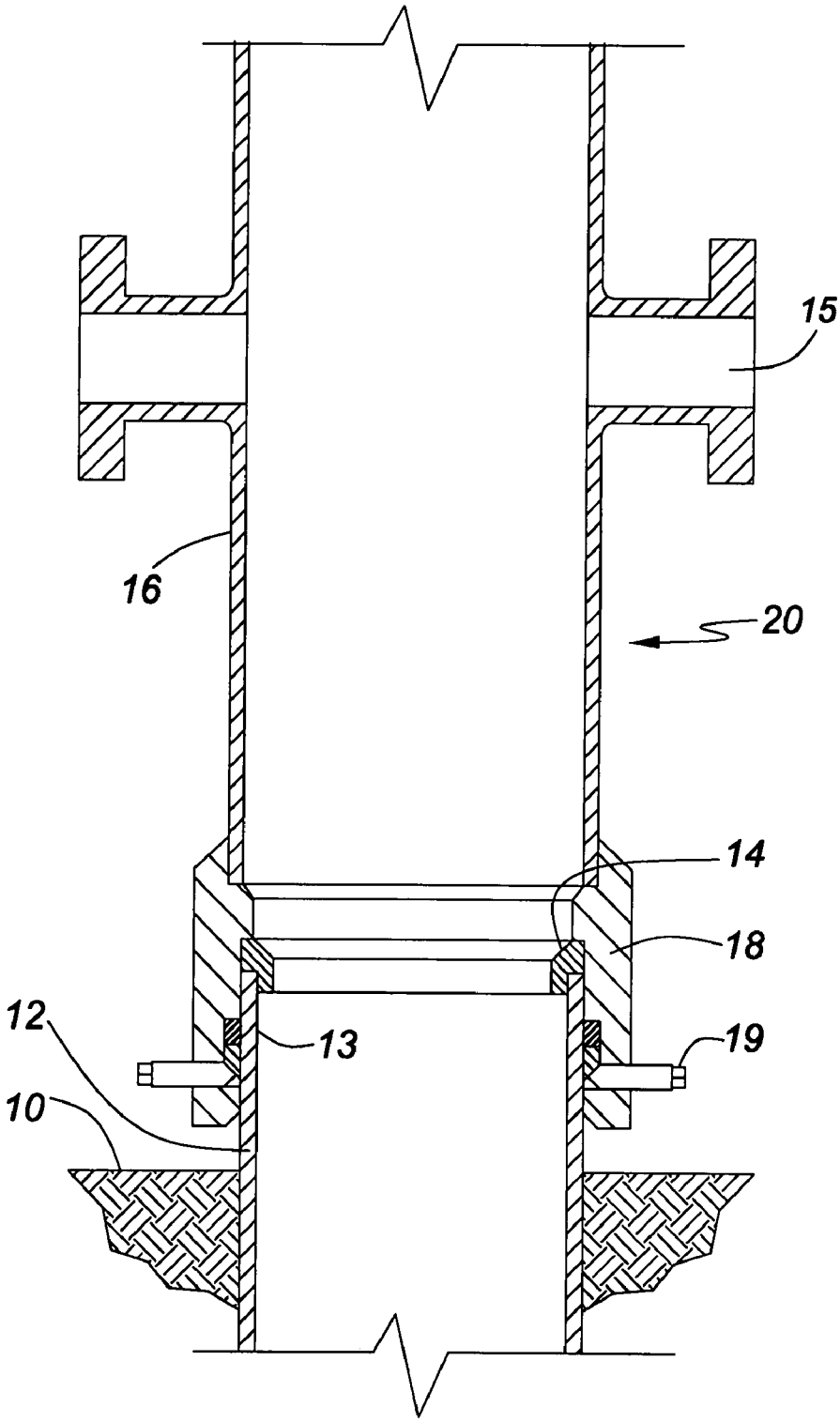
FIG. 1 (PRIOR ART)
FIG. 1 is a cross-sectional elevation view of a prior art conductor assembly in which a conductor window is mounted to a conductor ring that is affixed to a top end of a conductor.

As illustrated in FIG. 1, a conductor 12 is inserted (or, in the jargon, "stuffed") into the rat-hole that is dug into the ground or bedrock 10. The upper portion of the conductor 12 that protrudes above ground level is referred to as a "conductor nipple" 13. A conductor ring 14 (also known as a conductor bushing) is fitted atop the upper lip of the conductor nipple 13. The conductor ring 14 has an upper beveled surface defining a conductor bowl 14*a*.

A conductor window 16, which has discharge ports 15, is connected to the conductor nipple 13 via a conductor pipe quick connector 18 which uses a pair of locking pins 19 to fasten the conductor window 16 to the conductor nipple 13. When fully assembled, the conductor window 16, the conductor ring 14 and the conductor 12 constitute a conductor assembly 20. At this point, a drill string (not shown, but well known in the art) is introduced to bore a hole that is typically 600-800 feet deep with a diameter large enough to accommodate a surface casing.

Figure 2:
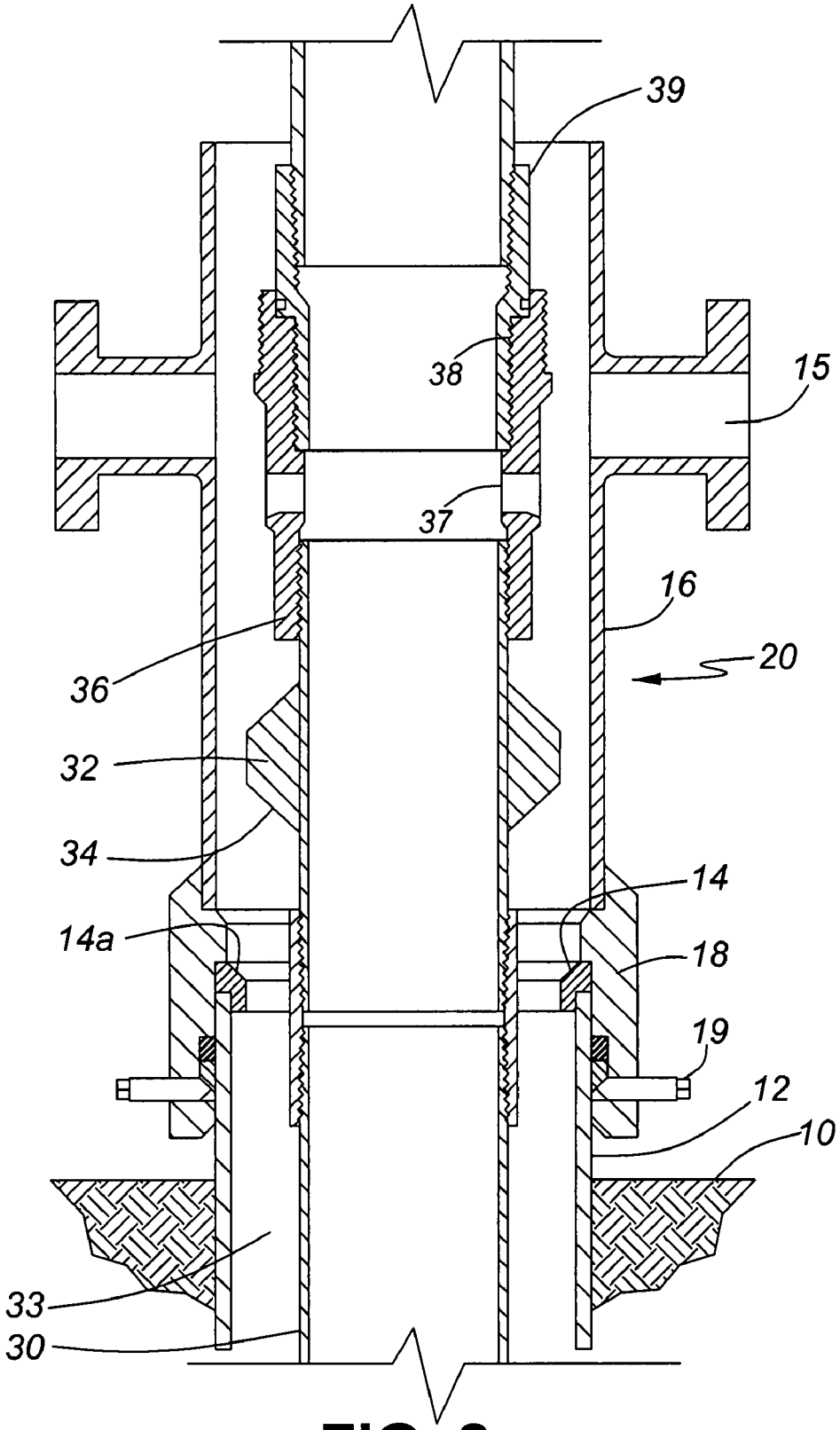
FIG. 2 is a cross-sectional elevation view of the running of a surface casing and wellhead in accordance with the invention into the prior art conductor assembly shown in FIG. 1.

As shown in FIG. 2, after drilling is complete, a surface casing 30 is inserted, or "run", through the conductor assembly 20 and into the bore. The surface casing 30 is connected at an upper end to landing lugs 32 which have a lower beveled surface shaped to rest against the conductor bowl 14*a*. The surface casing 30 is run into the bore until the lower beveled surface 34 of the landing lugs 32 contacts the conductor bowl 14*a*, as shown in FIG. 3.

As shown in FIG. 2, the surface casing 30 is a tubular string having an outer diameter less than the inner diameter of the conductor 12, thereby defining an annular space 33 between the conductor and the surface casing. The annular space 33 serves as a passageway for the outflow of mud when the surface casing is cemented in, a step that is well known in the art. Mud flows back up through the annular space 33 and out the discharge ports 15 located in the conductor window 16. The annular space 33 is eventually filled up with cement during the cementing stage so as to set the surface casing in place.

A wellhead 36 (also known as a "casing head") in accordance with the invention is connected to the surface casing 30 above the landing lugs 32 to provide a wellhead-surface casing assembly. The wellhead 36 has side ports 37 (also known as flow-back ports) for discharging mud during subsequent cementing operations (which will be described below). The wellhead also has a casing bowl 38, which is an upwardly flared bowl-shaped portion that is configured to receive a casing mandrel, as also will be explained below. As illustrated in FIG. 2, the wellhead 36 is connected by threads to a landing tool 39. The landing tool 39 is used to insert the wellhead-surface casing assembly and to guide this assembly down into the bore until the landing lugs contact the conductor bowl. Once the surface casing 30 is properly cemented into place, the landing tool 39 is unscrewed from the wellhead 36 and removed.

Figure 3:
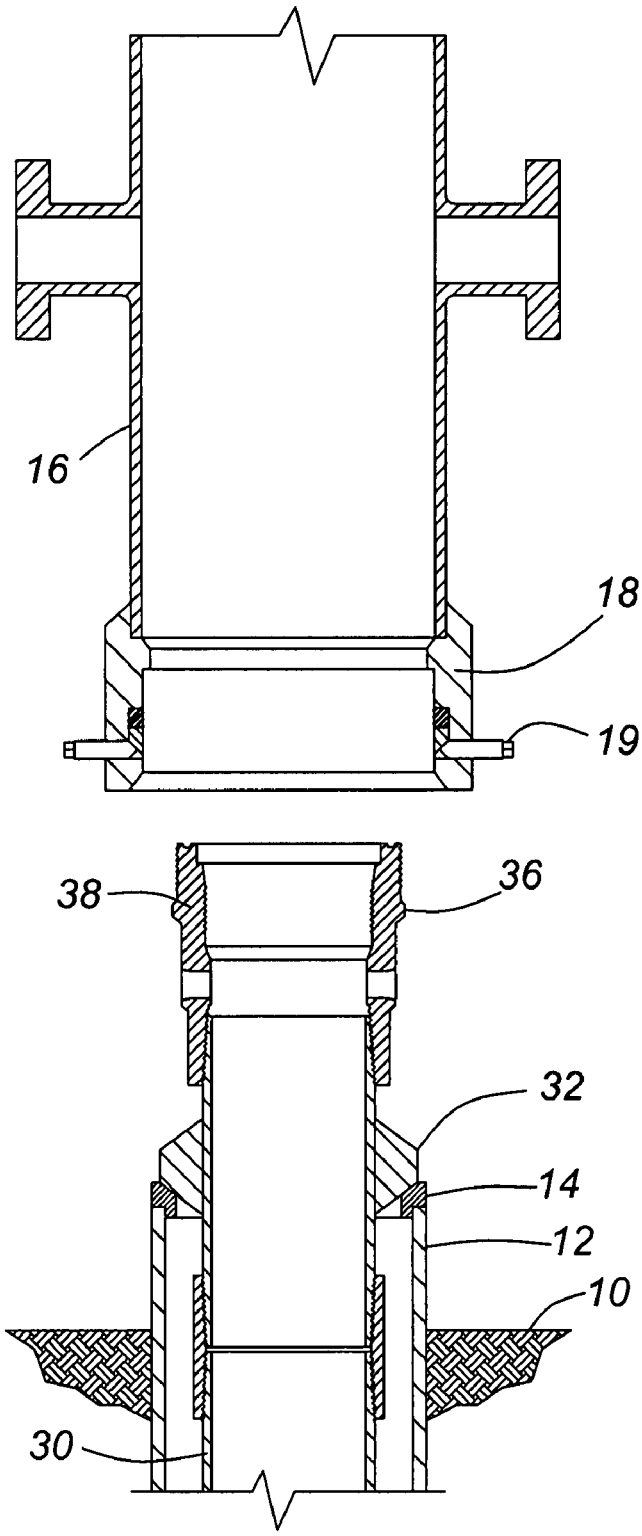
FIG. 3 is a cross-sectional elevation view of the wellhead, surface casing and conductor after removal of the landing tool and conductor window.

As shown in FIG. 3, the conductor window 16 is then detached from the conductor 12 by disengaging the locking pins 19 of the quick connector 18. After the conductor window 16 has been removed, as shown, what remains is the wellhead-surface casing assembly (i.e., the wellhead 36, the landing lugs 32, and the surface casing 30) sitting atop the conductor ring 14 and the conductor 12.

Figure 4:
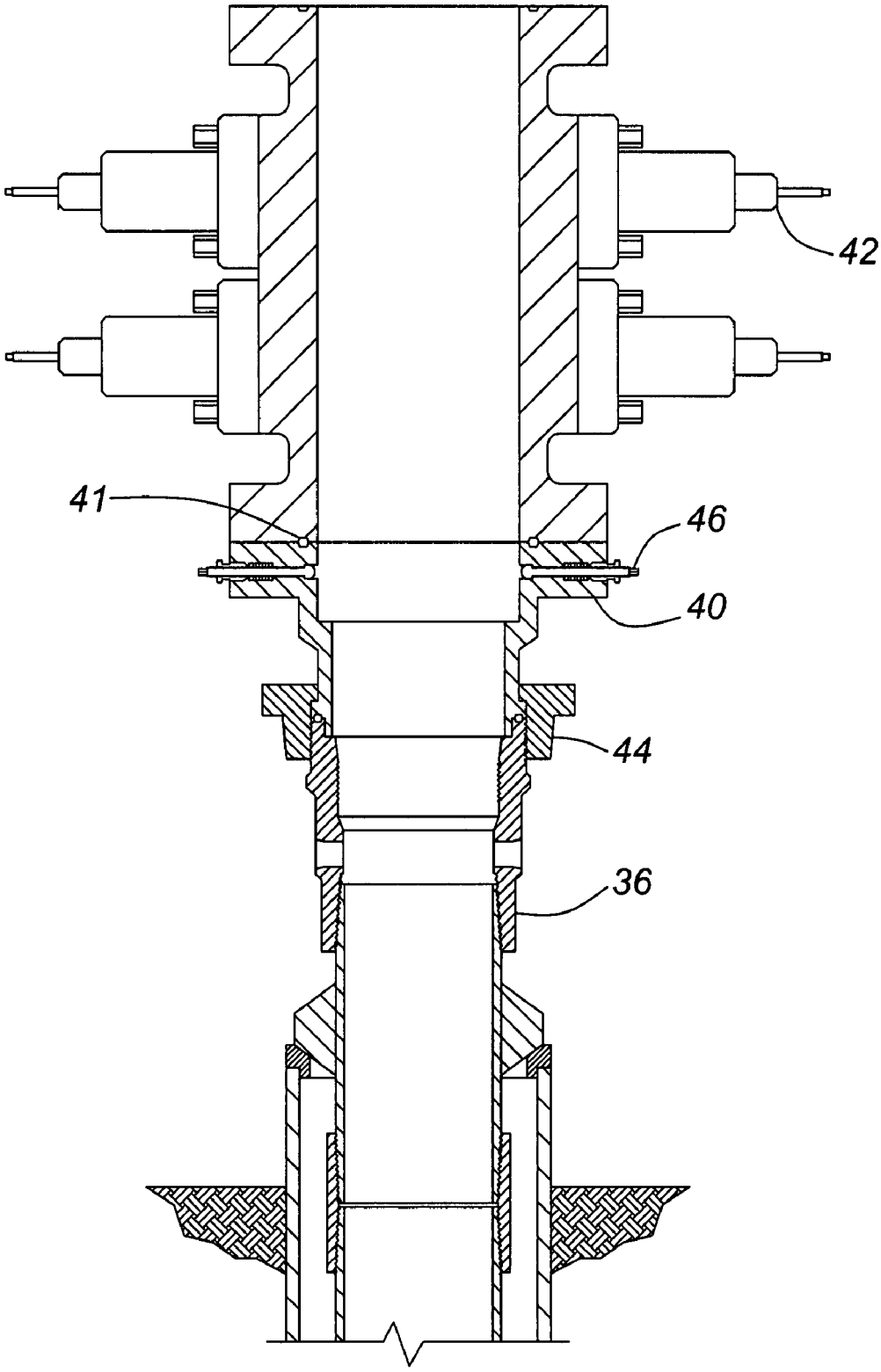
FIG. 4 is a cross-sectional elevation view of a pressure-control stack, including a drilling flange and blowout preventer, mounted to the wellhead shown in FIGS. 2 and 3.

FIG. 4 depicts a drilling flange 40 in accordance with the invention and a blowout preventer 42, together providing a pressure-control stack, secured to the wellhead 36 by a threaded union 44, such as a lockdown nut or hammer union. The wellhead 36 has a pin thread that engages a box thread of the threaded union 44. The blowout preventer (BOP) is secured to a top flange of the drilling flange 40. A ring gasket 41, which is either metallic or elastomeric, is compressed between the BOP 42 and the drilling flange 40 to provide a fluid-tight seal. The drilling flange 40 further includes locking pins 46, which are received in transverse bores in the drilling flange 40 and which are used to lock in place test plugs and bushings as will be described below. The drilling flange 40 and blowout preventer 42 are mounted to the wellhead 36 in order to drill a bore into or adjacent to the subterranean hydrocarbon formation. But before drilling can be commenced, the pressure-integrity of the pressure-control system, or "stack", must be tested.

Figure 5:
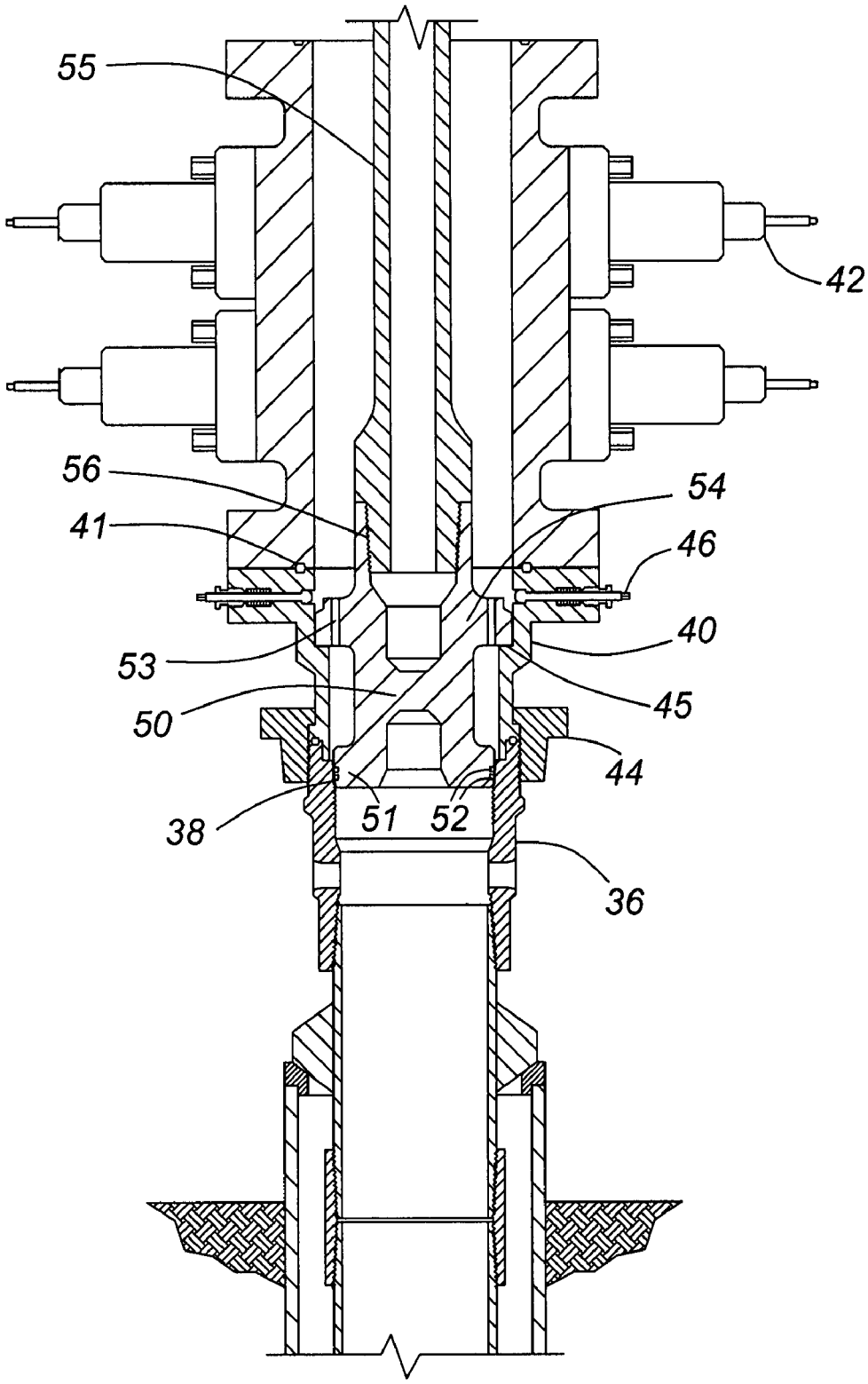
FIG. 5 is a cross-sectional elevation view showing a test-plug landing tool inserting a test plug into the pressure-control stack shown in FIG. 4.

FIG. 5 illustrates the insertion of a test plug 50 for use in testing the pressure-integrity of the stack. The pressure-integrity testing is effected by plugging the stack with the test plug 50, closing all valves and ports (including a set of pipe rams and blinds rams on the BOP) and then pressurizing the stack. The test plug 50 is inserted using a test plug landing tool 55 which is threaded to the test plug 50 at a threaded connection 56.

A bottom sealing portion 51 of the test plug is shaped to sit in the casing bowl 38. Machined into the bottom sealing portion 51 is a pair of annular grooves 52 into which O-rings may be seated to provide a fluid-tight seal between the test plug 50 and the casing bowl 38. The test plug further includes fluid passages 53 through which fluid may flow during pressurization of the stack. The fluid passages 53 are located in an upper shoulder portion 54 of the test plug 50. The upper shoulder portion 54 of the test plug abuts a drilling flange shoulder 45 and is locked in place by the locking pins 46, thereby securing the test plug in the stack. The landing tool 55 is removed and the stack is pressurized to at least an estimated operating pressure. If all seals and joints withstand the test pressure, the test plug is removed and the drill string is inserted.

Figure 6:
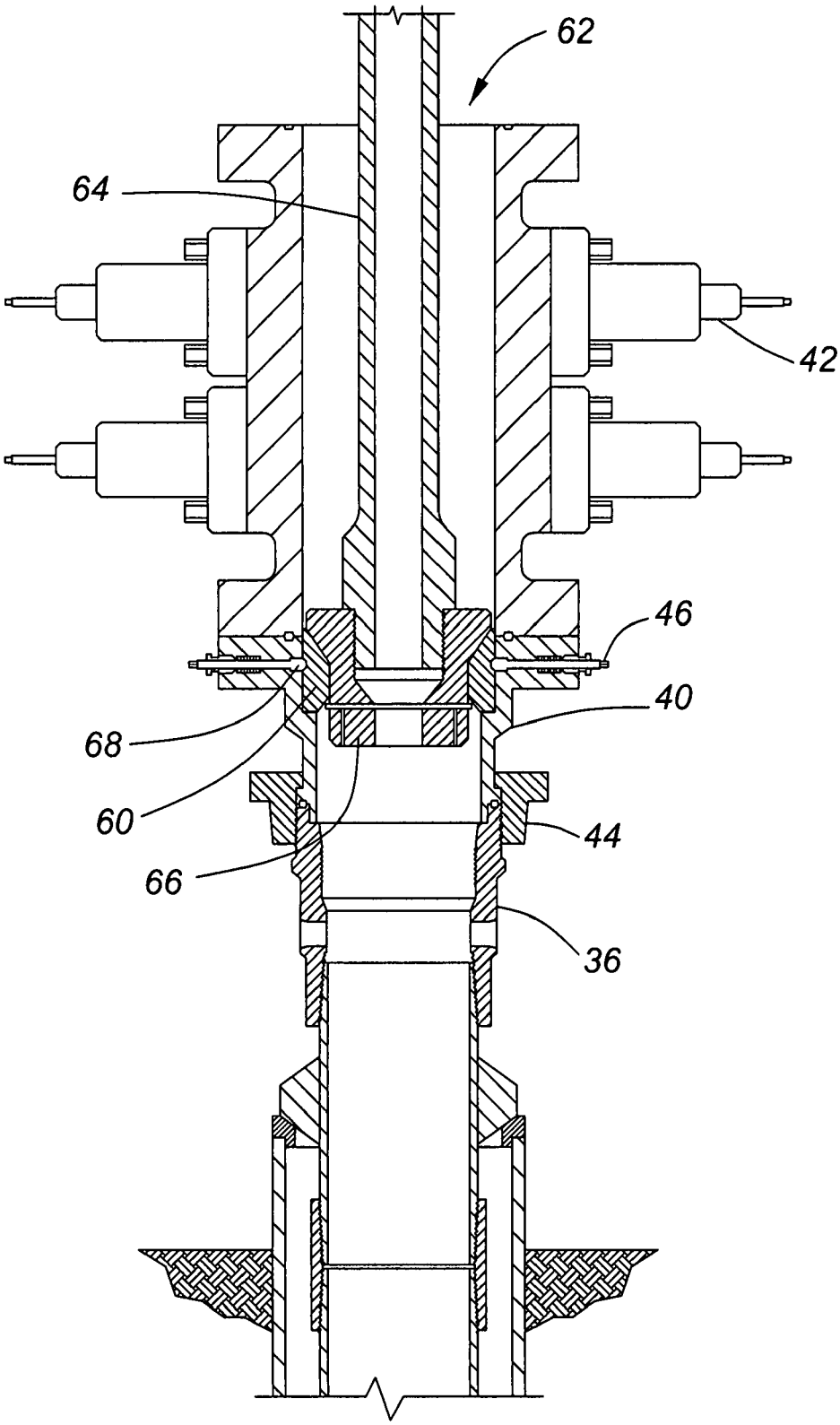
FIG. 6 is a cross-sectional elevation view of the pressure-control stack shown in FIG. 4 after the test plug has been withdrawn and a wear bushing has been inserted using a wear bushing landing tool.

As shown in FIG. 6, after the pressure-integrity of the stack is tested, preparations for drilling are commenced. This involves the insertion of a wear bushing 60 using a wear bushing landing tool 62. The wear bushing landing tool 62 includes an insertion joint 64, which is used to guide the wear bushing 60 to the correct location the drilling flange 40. The wear bushing landing tool 62 also has a bushing support 66 threadedly connected at a bottom end of the insertion joint 64 for releasably supporting the bushing. The wear bushing 60 is inserted into the drilling flange 40 and is then locked in place using the locking pins 46. A head of each locking pin 46 engages an annular groove 68 to lock the wear bushing 60 in place.

Once the wear bushing 60 is locked in place, the wear bushing landing tool 62 is retracted, leaving the wear bushing 60 locked inside the drilling flange 40. The stack is thus ready for drilling operations. A drill string (not illustrated, but well known in the art) is introduced into the stack so that it may rotate within the wear bushing. Drilling of a bore to the production depth may then begin.

Figure 7:
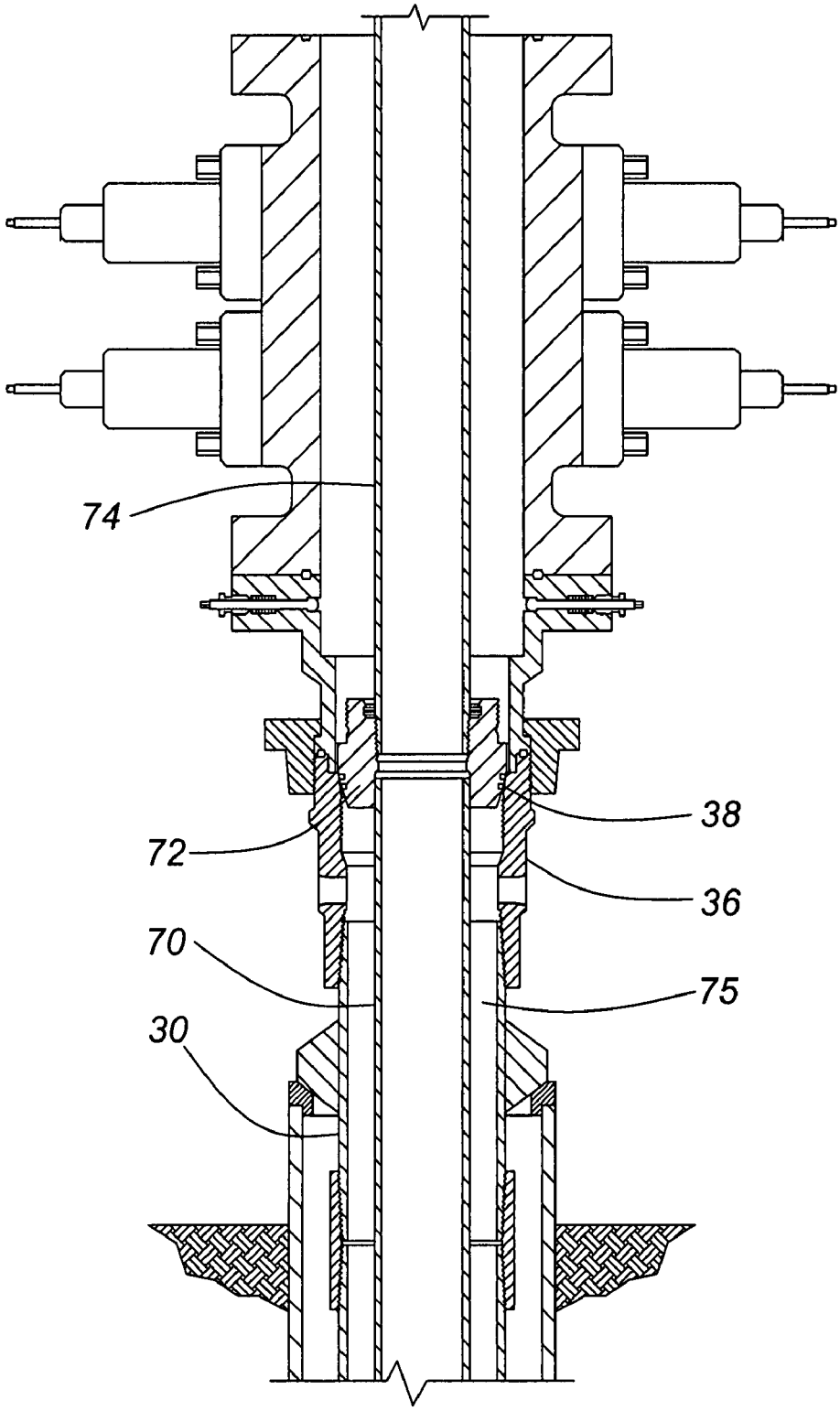
FIG. 7 is a cross-sectional elevation view of a production casing which is run into the pressure-control stack until a casing mandrel is seated in a casing bowl of the wellhead.

As shown in FIG. 7, once drilling of the bore is complete, a production casing 70 is run into the well bore through the stack. The production casing 70 is run into the well bore until a production casing mandrel 72 in accordance with the invention, is seated in the casing bowl 38 of the wellhead 36. As illustrated, the casing mandrel 72 is threadedly secured to the top end of the production casing 70. A landing tool 74 is threadedly secured to the casing mandrel 72 above the production casing 70. The landing tool 74 is used to lower the casing mandrel into the casing bowl 38.

The production casing 70 is a tubular string having a smaller diameter than that of the surface casing 30. An annular space 75 is thus defined between the production casing 70 and the surface casing 30. This annular space 75 is filled with cement to "cement in" the production casing. After the casing mandrel 72 is seated in the casing bowl 38, the production casing 70 is cemented in. Drilling mud is evacuated through the side ports 37 (also known as flow-back ports, discharge ports or outflow ports). Cementing is complete when cement begins to discharge from the side ports 37. Once the production casing 70 is cemented the landing tool 74 is detached and retracted.

Figure 8:
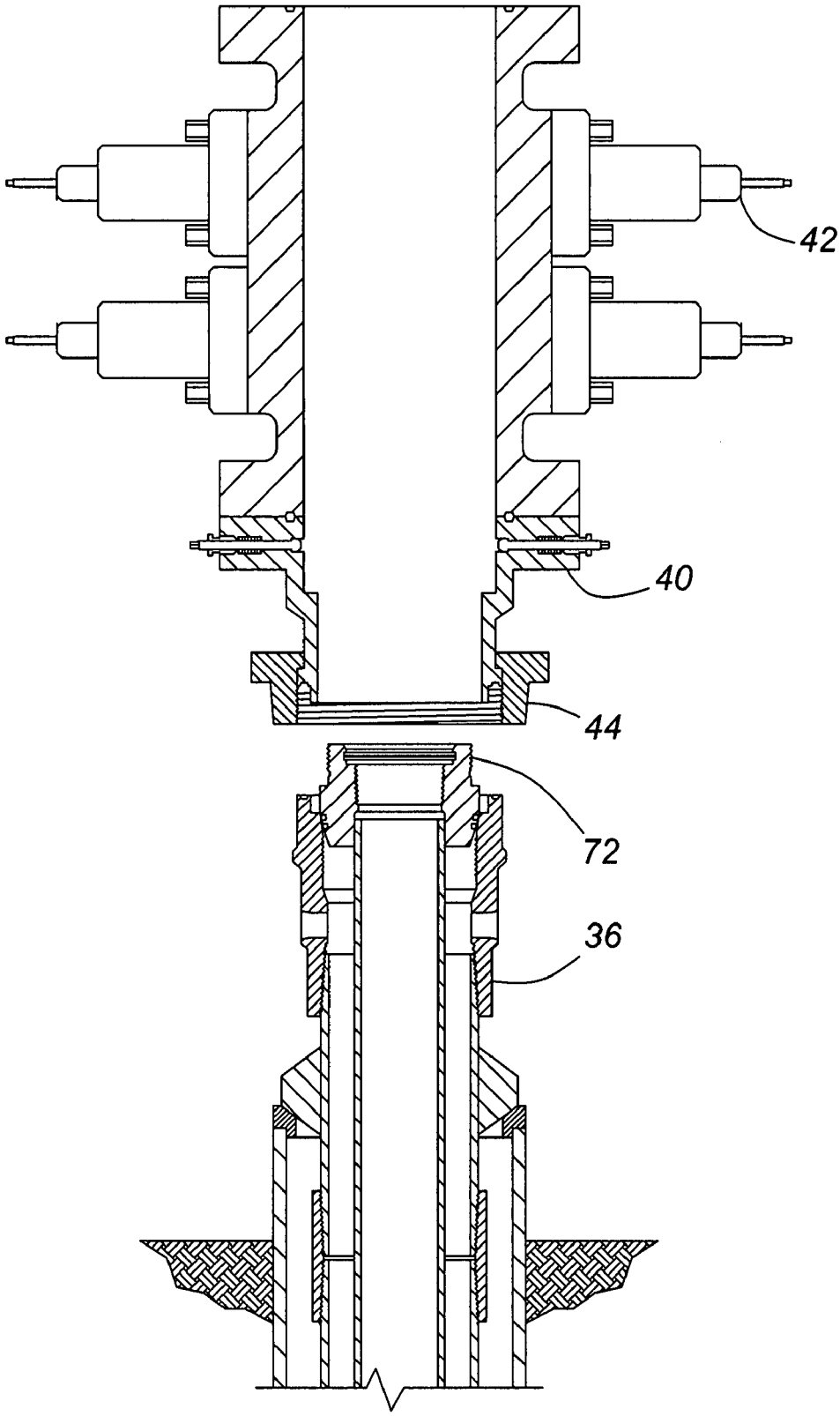
FIG. 8 is a cross-sectional elevation view showing the removal of the drilling flange and blowout preventer from the wellhead.

As shown in FIG. 8, after the casing mandrel 72 is seated and the production casing 70 cemented in, the drilling flange 40 and the blowout preventer 42 are removed by unscrewing the threaded union 44. When the drilling flange 40 and blowout preventer 42 are removed, the casing mandrel 72 is exposed atop the wellhead 36.

Figure 9:
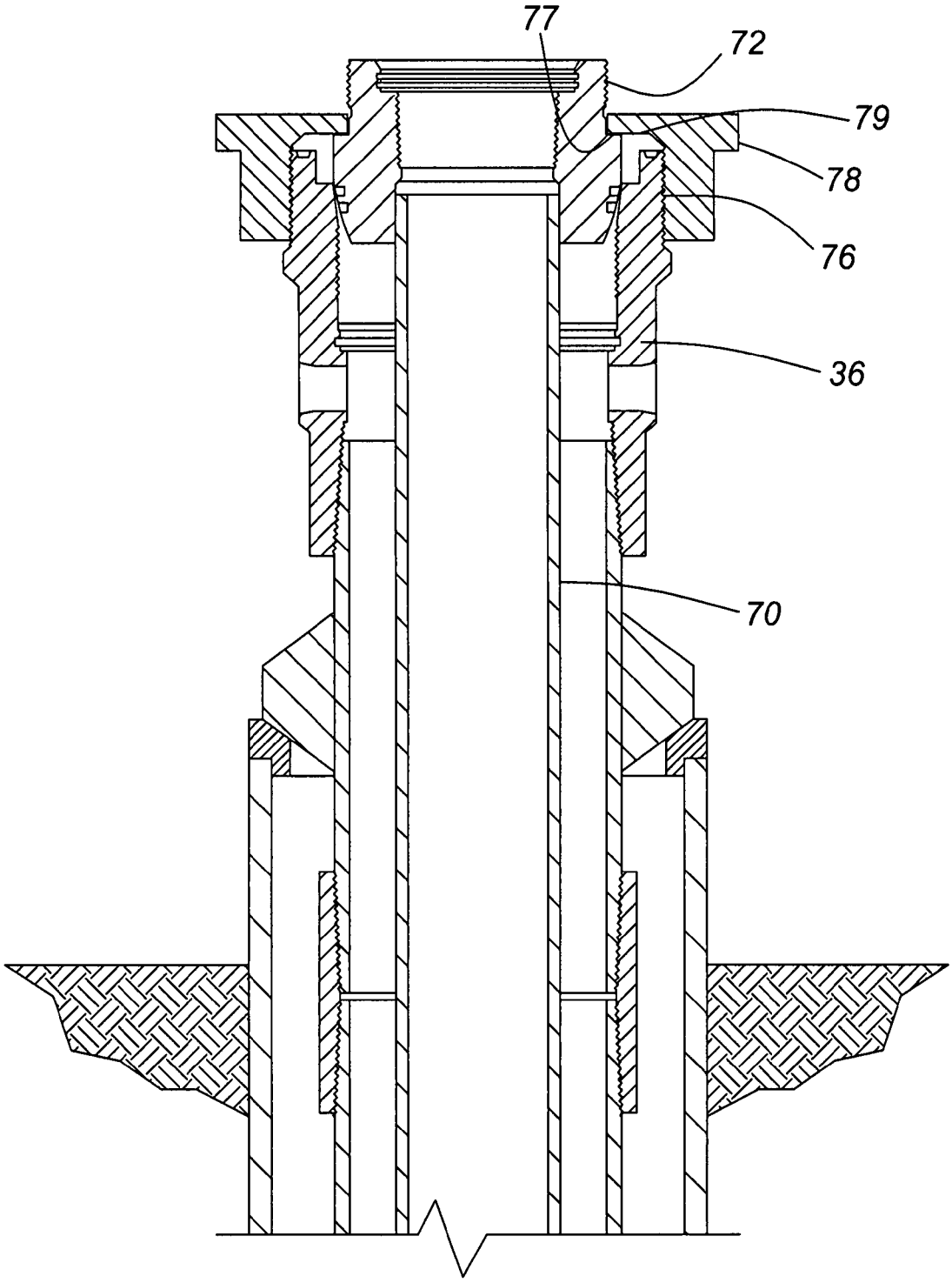
FIG. 9 is a cross-sectional elevation view showing the casing mandrel secured to the wellhead using a threaded union.

FIG. 9 illustrates how the casing mandrel 72 is secured to the wellhead 36 using another threaded union 78, such as a spanner nut or a hammer union. The threaded union 78 illustrated in FIG. 9 has an inner shoulder 79 which abuts with an outer shoulder 77 of the casing mandrel 72. The threaded union 78 has box threads 76 that engages pin threads on at a top of the wellhead 36. When the threaded union 78 is tightened, the inner shoulder 79 is drawn downwardly on the outer shoulder 77, thus securing the casing mandrel 72 to the wellhead 36.

Generally, prior to extracting the subterranean hydrocarbons, it is either necessary or advantageous to stimulate the well by acidizing or fracturing the subterranean hydrocarbon formation. Stimulation techniques such as acidizing or fracturing the formation are well known in the art and will thus not be described in detail.

Figure 10:
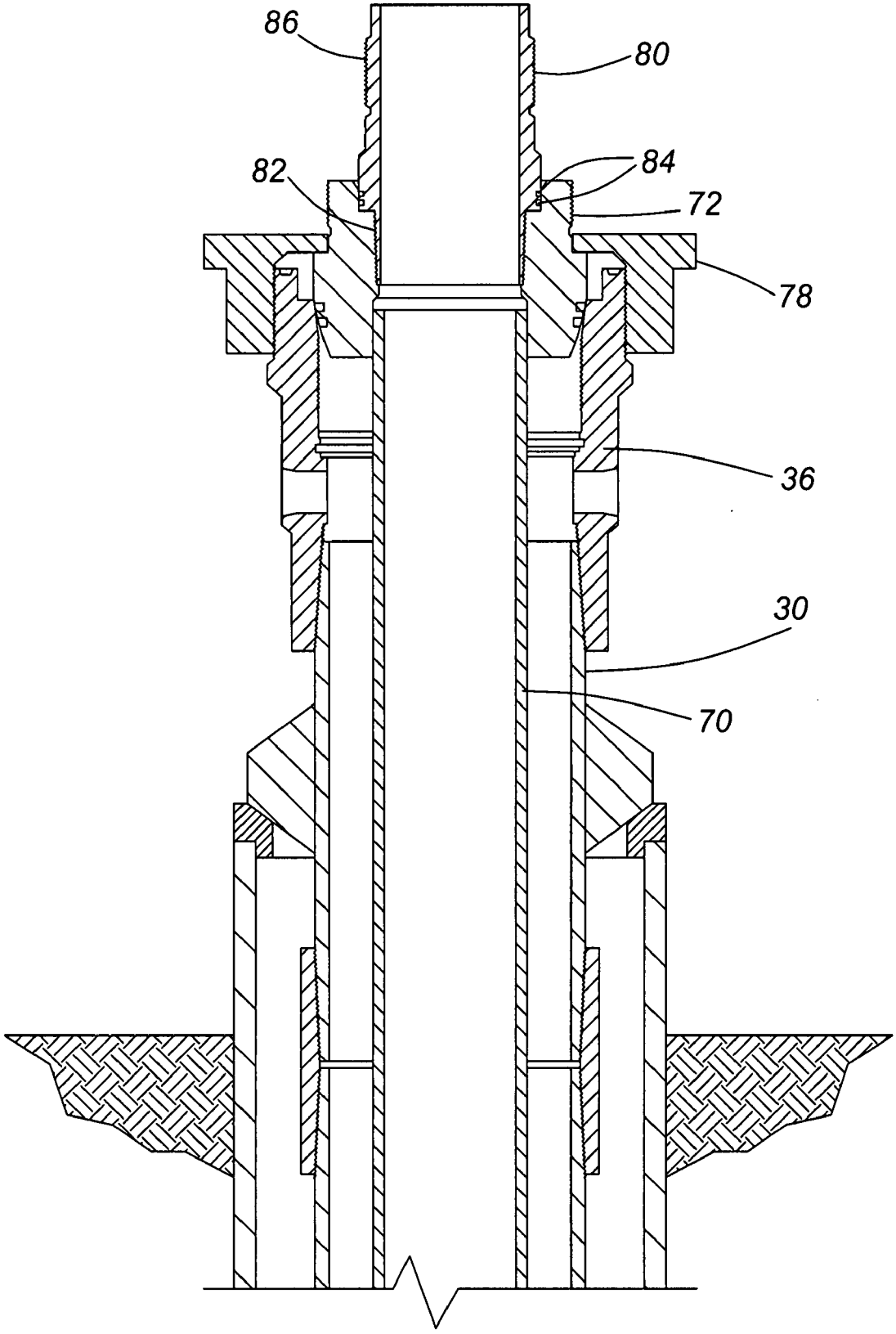
FIG. 10 is a cross-sectional elevation view showing an adapter pin in accordance with the invention connected to a top of the casing mandrel.

Before commencing fracturing operations, an adapter pin 80 in accordance with the invention is secured by a pin thread 82 to a box thread of the casing mandrel 72 as shown in FIG. 10. The adapter pin 80 includes a pair of annular grooves 84 in which O-rings are seated for providing a fluid-tight seal between the adapter pin 80 and the casing mandrel 72. The adapter pin 80 also has an upper pin thread 86 for engaging a box thread of a frac stack adapter flange, which will be described below.

Figure 11:
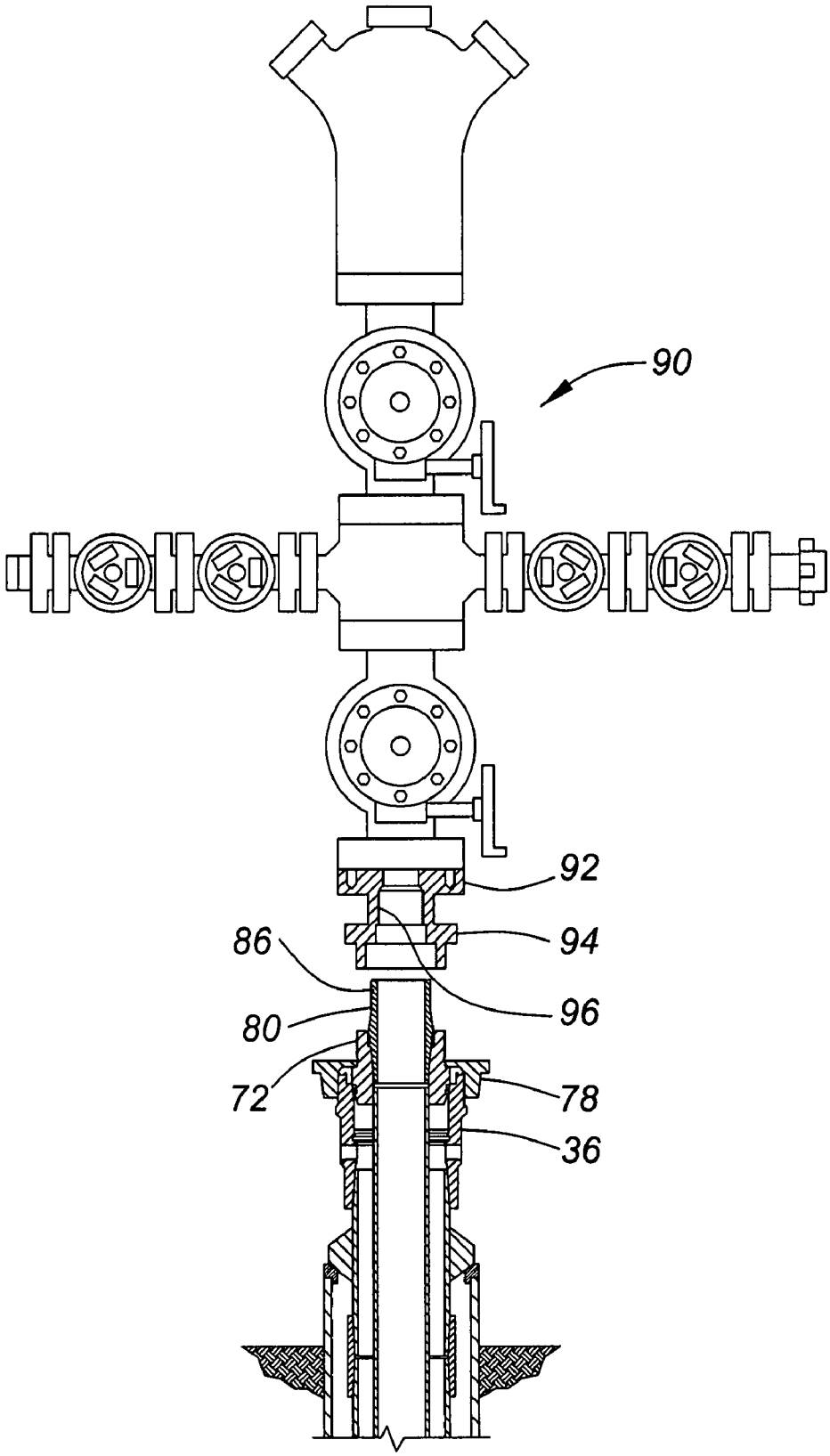
FIG. 11 is a cross-sectional elevation view of a frac stack being mounted to the casing mandrel using a threaded union, a frac stack adapter flange and the adapter pin shown in FIG. 10.

FIG. 11 illustrates how a "frac stack" 90 is mounted to the casing mandrel 72. A frac stack is a device well known in the art for injecting fracturing fluids into a well bore. Fracturing of the well involves the pumping into the well of proppants such as bauxite and sand and/or high-pressure fluids that break up or open the subterranean hydrocarbon formation. Fracturing is well known in the art as an effective technique for stimulating the production of a well. The frac stack 90 is secured by a flanged connection to a frac stack adapter flange 92 which is located on the underside of the frac stack as shown in FIG. 11. The frac stack adapter flange 92 is, in turn, secured to the casing mandrel 72 using another threaded union 94. The frac stack adapter flange 92 also has a box thread 96 which engages the pin thread 86 of the adapter pin 80.

As can be seen in FIG. 11, the casing mandrel 72, adapter pin 80 and adapter flange 92 provide full-bore access to the production casing 70. This permits all aspects of well completion to proceed without interruption. Thus, logging tools, perforating guns, packers, plugs and any other downhole tool can be run into the production casing 70 without removing the frac stack 90. This permits well completion to be effected without the delays that are encountered using prior art wellhead systems. Consequently, well completion time is significantly reduced and well completion costs are correspondingly reduced.

As is well understood in the art, the completed well is a "live" well and is normally pressurized by natural well pressure. Consequently, the frac stack cannot be removed until the casing is sealed off to prevent the escape of well fluids to atmosphere. After fracturing and flow-back are complete, a wireline plug, or some equivalent packer, is set in the casing to seal off the casing. In addition, water may be pumped into the casing over the plug as an additional safety measure before the frac stack is removed.

Figure 12:
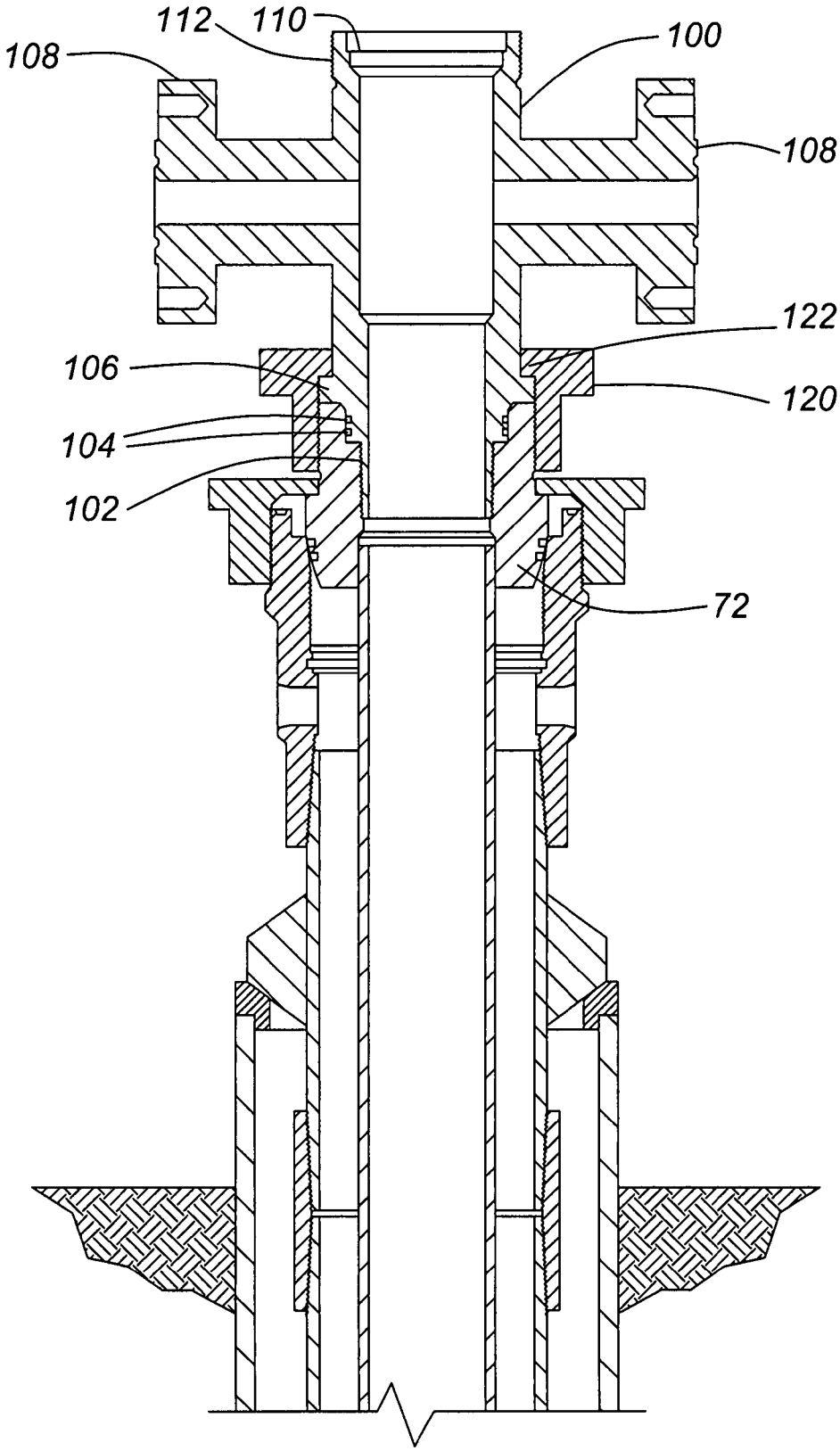
FIG. 12 is a cross-sectional elevation view of a tubing head spool secured to the casing mandrel after fracturing operations have been completed and the frac stack, the adapter flange and the adapter pin have been removed.

The frac stack 90, the frac stack adapter flange 92 and the lockdown nut 94 are then detached and removed. The adapter pin 80 is also detached and removed to make way for a tubing head spool 100 which is secured to the casing mandrel 72 using another threaded union 120 as shown in FIG. 12. The tubing head spool 100 supports a production tubing string as described below.

As illustrated in FIG. 12, the tubing head spool 100 has lower pin thread 102 for connection to the casing mandrel 72. The tubing head spool also has a pair of annular grooves 104 in which O-rings are seated for providing a fluid-tight seal between the tubing head spool 100 and the casing mandrel 72. Above the annular grooves 104 is a radial shoulder 106, which engages an inner shoulder 122 of the lockdown nut 120 when the lockdown nut is tightened. The tubing head spool 100 also has a pair of flanged side ports 108. At the top end of the tubing head spool 100 is a beveled shoulder 110 for receiving a tubing hanger shown in FIG. 13. A set of pin threads 112 on the top end of the tubing head spool 100 engage a box thread of a threaded union 160 described below with reference to FIG. 15.

Figure 13:
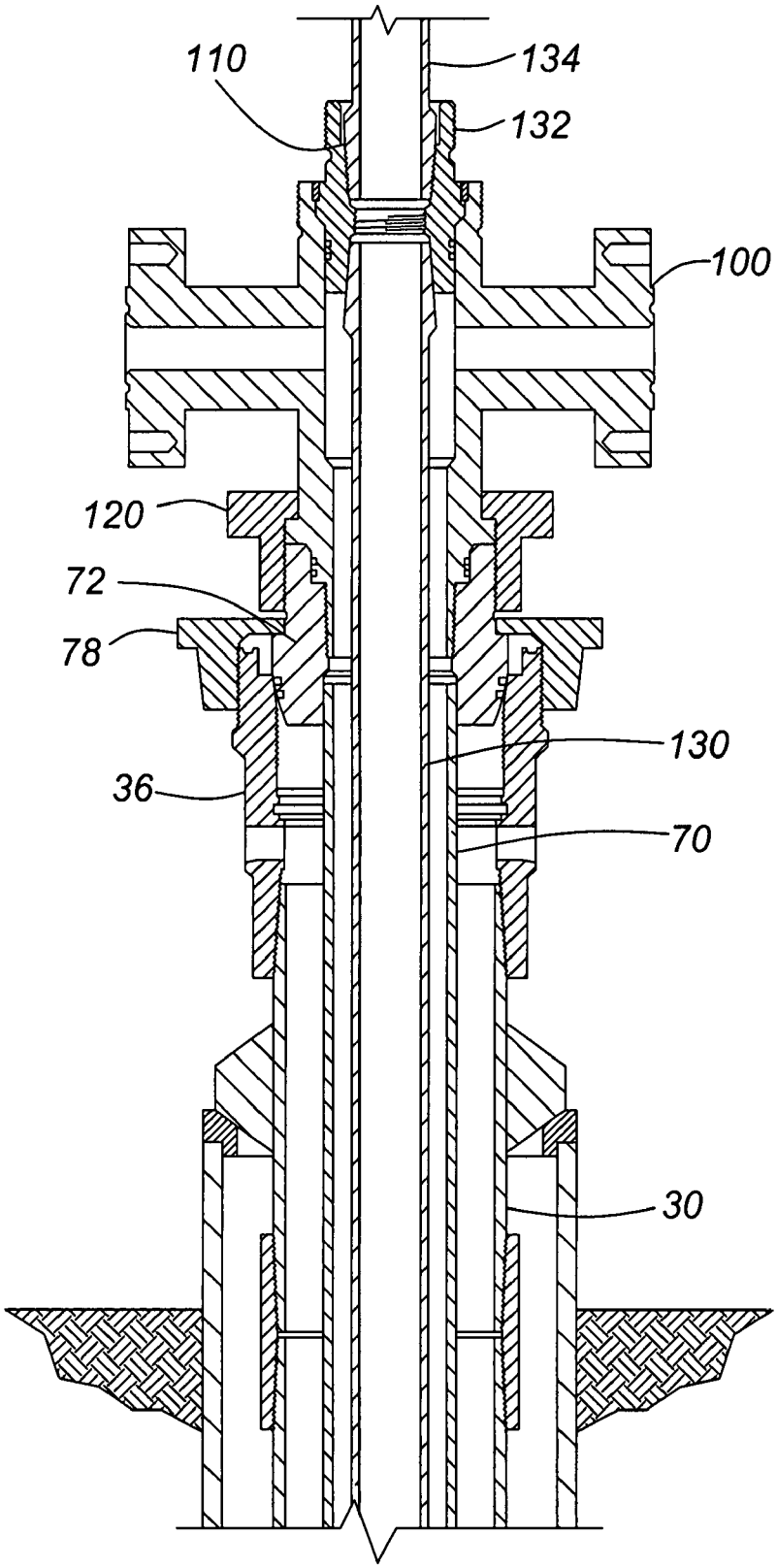
FIG. 13 is a cross-sectional elevation view of a tubing hanger seated in a bowl of the tubing heads spool with a production tubing suspended from the tubing hanger.
Figure 14:
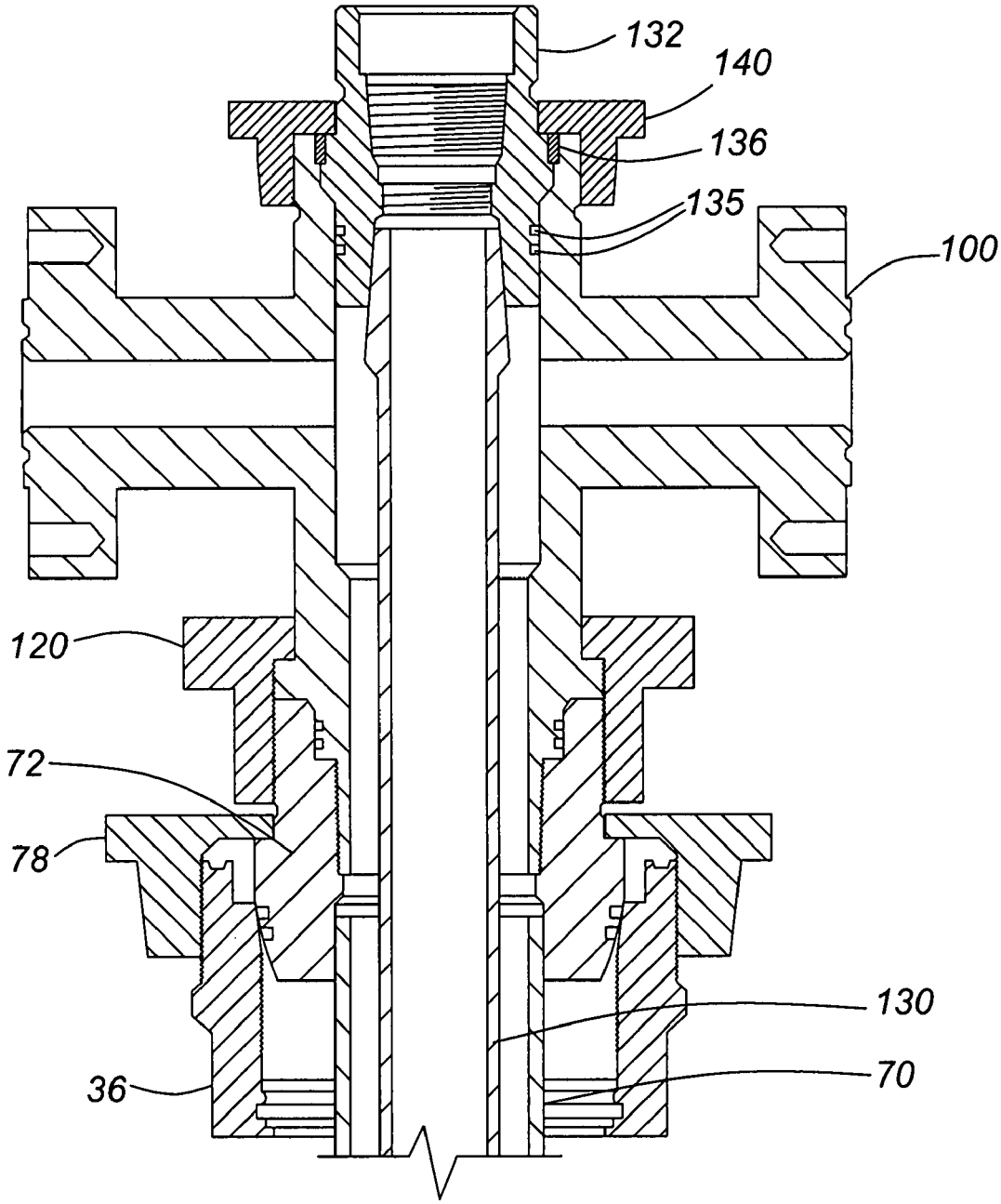
FIG. 14 is a cross-sectional elevation view of the tubing hanger secured to the tubing head spool by a threaded union.

As illustrated in FIG. 13, a production tubing 130 is run inside the production casing 70 all the way down to the subterranean hydrocarbon formation (which is referred to as a production zone). In order to accomplish this, the casing plug, and overbearing fluid if used, must be removed. The plug (and fluid) is removed by mounting a changeover (not shown) such as a Bowen union or the like to a top of the tubing head 100 and mounting a blowout preventer (BOP) stack (not shown) to the changeover. The BOP, permits the casing plug to be retrieved and the tubing to be run into the well without "killing" the well, in a manner that is known in the art. After the tubing is run into the well it is suspended by a tubing hanger 132 connected to a top end of the tubing string. Fluid seals 135 (FIG. 4) between the tubing hanger 132 and the tubing head spool 100 prevent the escape of well fluids from the annulus between the production tubing string 130 and casing 170. A wireline plug is run into the production tubing string 130 to provide a fluid seal before the BOP stack is removed. Water may be pumped into the tubing string over the wireline plug for extra security. The tubing hanger 132 (also referred to as a tubing mandrel) is secured to the tubing head spool 100 by another threaded union 140 (FIG. 14). As shown in FIG. 13, the tubing hanger 132 is connected by a threaded connection to a production tubing string landing tool 134, which is used to insert and guide the tubing hanger 132 through the BOP stack so that it sits on top of the beveled shoulder 110 near the top of the tubing head spool 100. The production tubing string 130 is used as a conduit for extracting hydrocarbons from the production zone of the well.

As shown in FIG. 14, the tubing hanger 132 (which secures and suspends the production tubing string 130 in the well) is secured to the tubing head spool 100 by the threaded union 140. The tubing hanger 132 has a pair of annular grooves 135 in which O-rings are seated to provide a fluid-tight seal between the tubing hanger 132 and the tubing head spool 100. An annular packing 136 is compressed beneath the lockdown nut 140 between the tubing hanger 132 and the tubing head spool 100.

Figure 15:
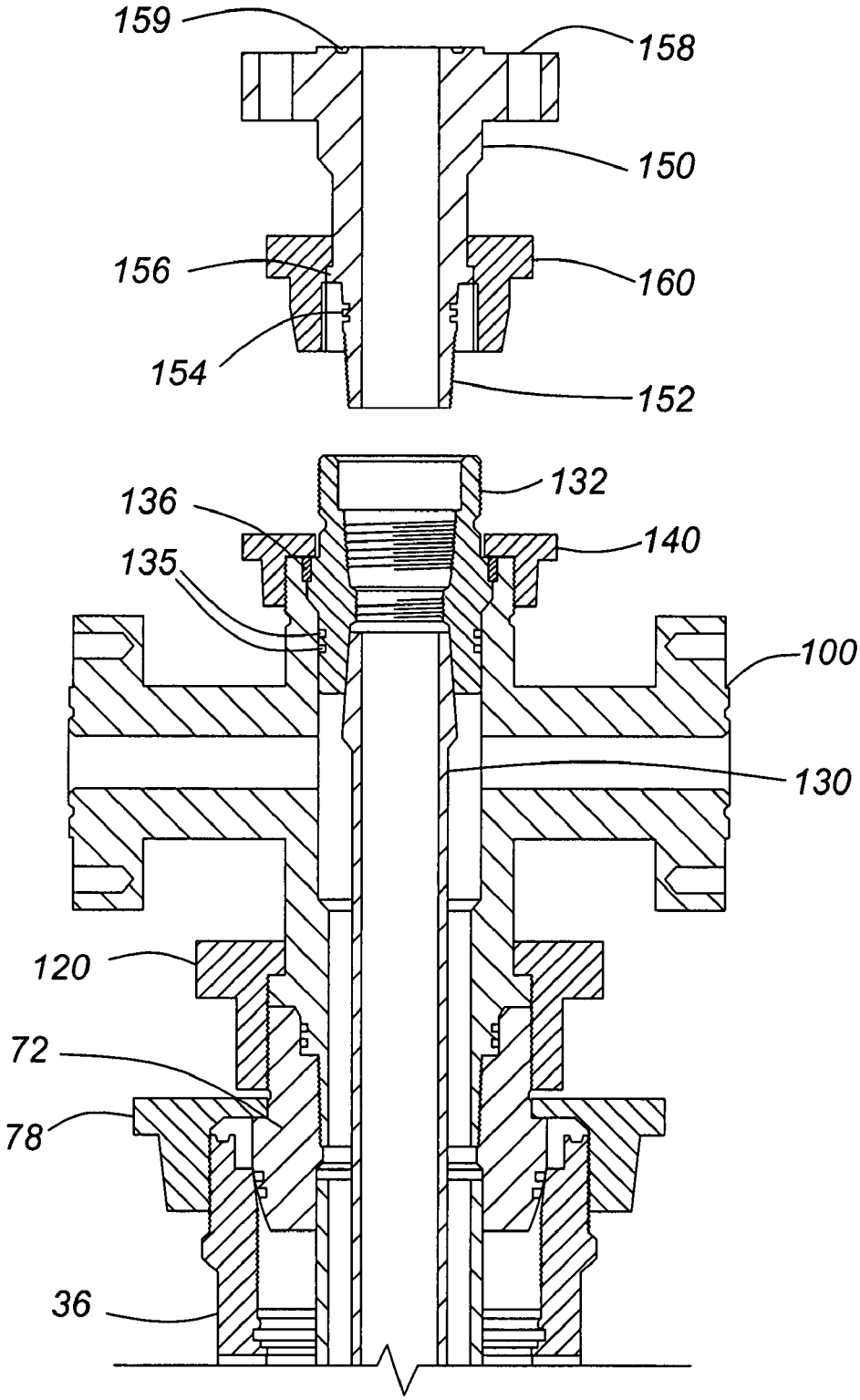
FIG. 15 is a cross-sectional elevation view of an adapter flange being mounted to the tubing hanger.

Once the production tubing 130 has been run down to the production zone and the tubing hanger 132 secured, the wellhead system can be completed by attaching to the top of the stack one of various pieces of flow-control equipment, such as a master valve, choke, flow tee or other such flow-control device (none of which are shown, but which are all well known in the art). In order to attach a flow-control device, an adapter flange 150, shown in FIG. 15, is first mounted to the top of the stack. The adapter flange 150 is secured to the tubing hanger 132 by a threaded union 160. The adapter flange 150 has a pin thread 152 for engaging a corresponding box thread on the tubing hanger 132. The adapter flange 150 also has a pair of annular grooves 154 in which O-rings are seated to provide a fluid-tight seal between the adapter flange 150 and the tubing hanger 132. As illustrated in FIG. 15, the adapter flange 150 also has an annular shoulder 156 against which the threaded union 160 abuts. The adapter flange 150 further includes flange 158 at the top end for connection to one of various types of flow-control devices. An annular groove 159 is machined into the top surface of the adapter flange 150 for receiving a metal ring gasket to provide a fluid-tight seal at the flanged joint between the adapter flange 150 and the flow-control device.

Figure 16:
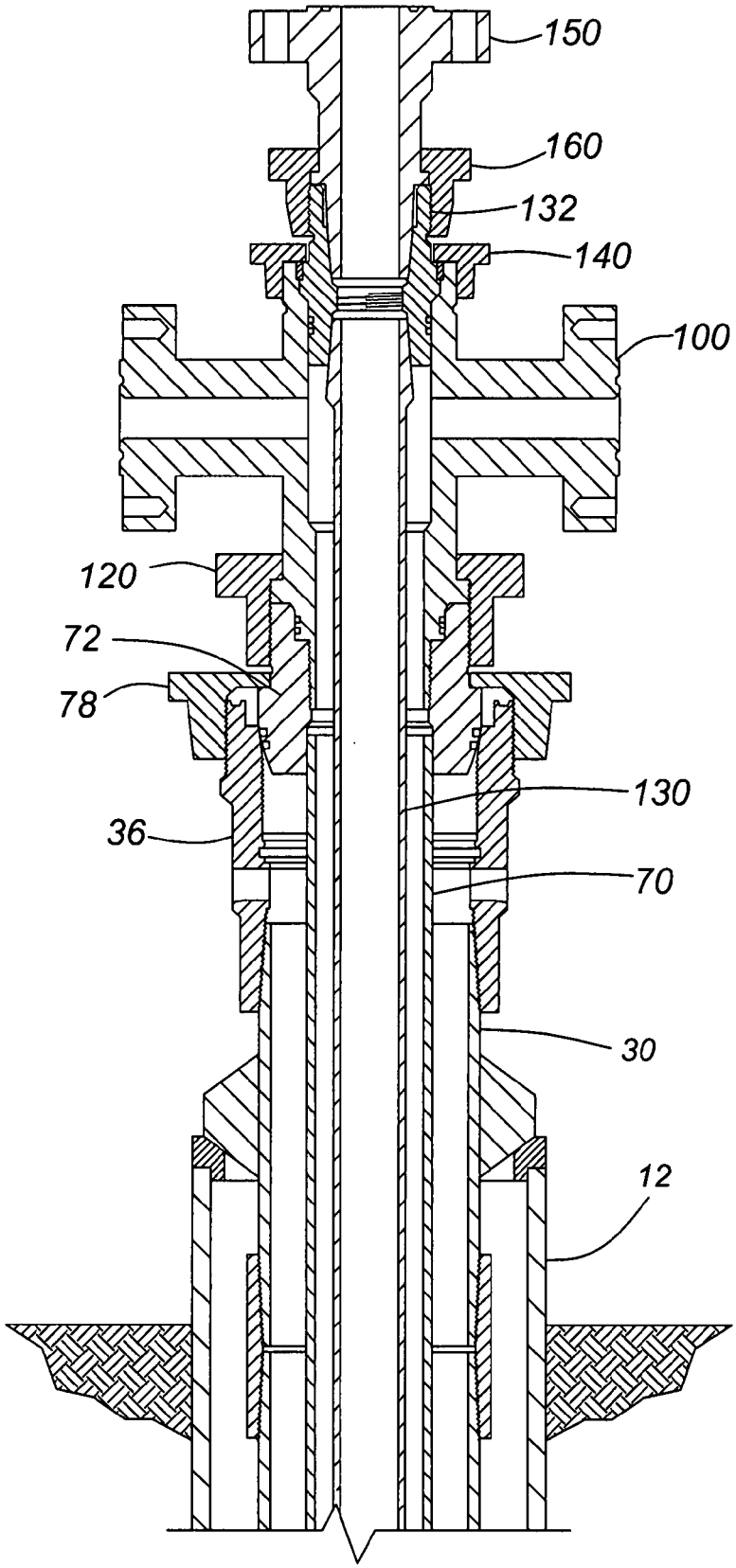
FIG. 16 is a cross-sectional elevation view of the completed wellhead system in accordance with an embodiment of the present invention.

FIG. 16 illustrates the completed wellhead system with the adapter flange 150 secured by the threaded union 160 to the tubing hanger 132. The stack is now ready to receive a flow-control device such as a flow-tee, choke or master valve. After the flow-control device is installed, a wireline is used to retrieve the plug from the production tubing string 130, and the well is ready for production. Importantly, the entire well completion process using a low-pressure wellhead system in accordance with the invention is accomplished without interruption and without killing the well, which has important economic benefits and generally improves production from the well.

The wellhead system employs four threaded unions for securing the tubular heads and the mandrels. The first threaded union 78 secures the casing mandrel 72 to the wellhead 36. The second threaded union 120 secures the tubing head spool 100 to the casing mandrel 72. The third threaded union 140 secures the tubing hanger 132 to the tubing head spool 100. The fourth threaded union 160 secures the adapter flange 150 to the tubing hanger 132.

The advantages of the wellhead system and method described and illustrated above are numerous. Because each of the mandrels and tubular heads is threadedly secured using threaded unions, the wellhead system is quick and easy to set up. This minimizes rig downtime and thus renders the extraction of subterranean hydrocarbons more economical.

A further advantage of this wellhead system and method is the rapid interchangeability of its heads. Because the mandrels and tubular heads are independently secured with threaded unions, the wellhead system permits rapid interchangeability of heads and fittings. For example, in the event that a production zone needs to be re-stimulated, the wellhead system can be easily re-tooled with a frac stack. Since the tubular heads are secured with threaded unions, the stack is easy to dismantle and reassemble, thereby reducing rig downtime.

Yet a further advantage of this wellhead system and method is the facility with which extraction operations can be moved from one production zone to another. Due to the design of the wellhead system, the stack can be readily re-tooled for different operations such as drilling, perforating, fracturing, and production setup. This wellhead system and method therefore reduces the time and cost required to complete a multi-zone well. As a result, exploitation of a low-pressure well becomes more economical.

As explained above, the wellhead system and method described and illustrated above is a "full bore open" design. The "full bore open" design permits direct insertion of various downhole tools such as a logging tool, a perforating gun, plugs, packers, hangers and any other downhole tools or equipment required for well completion or re-completion. Because tools can be directly inserted, the "full bore open" design reduces rig downtime and well completion costs.

Persons skilled in the art will appreciate that the wellhead system may be configured with other types or arrangements of threadedly secured heads and mandrels. The embodiments of the invention described above are therefore intended to be exemplary only. The scope of the invention is intended to be limited solely by the scope of the appended claims.

We claim:

1. A wellhead system for stimulating and extracting subterranean hydrocarbons from a low-pressure well, the system comprising:

a plurality of tubular heads, each tubular head having side ports and supporting a mandrel for suspending a tubular string in the well, each mandrel being secured to the tubular head that supports the mandrel by a threaded union, and each mandrel supporting one of:

a said tubular head which is secured by a threaded union to the mandrel that supports the tubular head, and an adapter flange for connecting production equipment to the wellhead system, the adapter flange being secured to the mandrel that supports the adapter flange by another threaded union.

2. The wellhead system as claimed in claim 1 comprising two of said tubular heads separated by one of the mandrels, the one of the mandrels being supported by a first of said tubular heads and the one of the mandrels supporting a second of said tubular heads.

3. The wellhead system as claimed in claim 1 wherein each threaded union comprises a nut.

4. The wellhead system as claimed in claim 3 wherein the nut comprises one of: a wing nut, and a spanner nut.

5. The wellhead system as claimed in claim 1 wherein the tubular strings suspended by the mandrels are concentrically disposed within a surface casing suspended by a wellhead, the wellhead being supported by a conductor assembly dug into the earth.

6. The wellhead system as claimed in claim 1 comprising:

a casing mandrel supported by a wellhead and secured to the wellhead by a threaded union, the wellhead securing and suspending a surface casing, the casing mandrel securing and suspending a production casing;

a tubing head spool supported by the casing mandrel and threadedly secured to the casing mandrel by a pin thread and a threaded union; and a tubing hanger secured to the tubing head spool by a threaded union, the tubing hanger securing and suspending a production tubing.

7. The wellhead system as claimed in claim 6 further wherein an adapter flange is threadedly secured to the tubing hanger by a pin thread and a threaded union, the last-mentioned adapter flange having an upper flange for connecting to a flow-control device.

8. The wellhead system as in claim 1, wherein each said tubular string is suspended by a respective said mandrel by a threaded connection between the tubular string and the respective mandrel.

9. A low-pressure wellhead system comprising:

an independent screwed wellhead having independently secured tubular heads, each, independently secured tubular head having side ports, and each independently secured tubular head supporting a respective mandrel that supports and suspends a respective tubular string in a well bore; and a respective threaded union for threadedly securing each of the respective mandrels to the independently secured tubular head that supports it, at least one the mandrels supporting one of the independently secured tubular heads, which is independently secured to that mandrel by another threaded union.

10. The wellhead system as claimed in claim 9 comprising a first tubular head threadedly secured to a surface casing of the wellhead system and a second tubular head, a first mandrel supported by the first tubular head and supporting the second tubular head and a second mandrel supported by the second tubular head.

11. The wellhead system as claimed in claim 10 wherein:

the first tubular head is a wellhead supported by a conductor assembly, the wellhead securing and suspending a surface casing in the well bore;

the first mandrel is a casing mandrel supported by the wellhead, the casing mandrel securing and suspending a production casing in the well bore;

the second tubular head is a tubing head spool supported by the casing mandrel, the tubing head spool supporting the second mandrel at an upper end thereof; and the second mandrel is a tubing hanger supported by the tubing head spool, the tubing hanger securing and suspending a production tubing in the well bore.

12. The wellhead system as claimed in claim 11 wherein the threaded unions comprise one of: a wing nut, and a spanner nut.

13. A method of completing a low-pressure well comprising steps of:

securing a first mandrel to a first tubular head using a first threaded union, the first tubular head supporting a first tubular string in the well, and the first mandrel supporting a second tubular string in the well;

securing a second tubular head to the first mandrel using a second threaded union; and securing a second mandrel to the second tubular head using a third threaded union, the second mandrel supporting a third tubular string in the well.

14. The method as claimed in claim 13 further comprising a step of securing an adapter flange to the second mandrel using a fourth threaded union.

15. A method of completing a low-pressure well after a conductor assembly has been installed in the ground above a subterranean hydrocarbon formation, the method comprising steps of:

landing a wellhead onto the conductor assembly, the wellhead securing and suspending a surface casing in the well;

securing a casing mandrel to the wellhead using a first threaded union, the casing mandrel securing and suspending a production casing in the well;

securing a tubing head spool to the casing mandrel using a second threaded union; and securing a tubing hanger to the tubing head spool using a third threaded union, the tubing hanger securing and suspending a production tubing in the well.

16. The method as claimed in claim 15 further comprising the step of securing an adapter flange to the tubing hanger using a fourth threaded union.

17. The method as claimed in claim 15 further comprising steps of:

after the step of securing the casing mandrel to the wellhead, securing a frac stack to the casing mandrel using a fourth threaded union, the frac stack having conduits for conveying proppants and pressurized fluids into the production casing for fracturing the subterranean hydrocarbon formation; and prior to the step of securing the tubing head spool to the casing mandrel, removing the frac stack from the casing mandrel.

18. The method as claimed in claim 17 wherein the step of securing the frac stack using the fourth threaded union further comprises the steps of:

securing a frac stack adapter flange to an underside of the frac stack; and securing an adapter pin to the casing mandrel, the adapter pin having pin threads for engaging box threads of the frac stack adapter flange.

19. A method of installing and completing a low-pressure wellhead system for the extraction of hydrocarbons from a subterranean hydrocarbon formation, the method comprising the steps of:

digging away earth above the subterranean hydrocarbon formation to accommodate a conductor;

installing a conductor window on the conductor;

running surface casing until a wellhead is seated above the conductor;

cementing the surface casing in place;

removing the conductor window to expose the wellhead;

mounting a blowout preventer and drilling flange to the wellhead using a first threaded union;

inserting a test plug into the wellhead system to test a pressure-integrity of the wellhead system;

removing the test plug after the testing of the pressure-integrity of the wellhead system is complete;

installing a wear bushing in the drilling flange;

drilling a bore to accommodate a production casing;

running in the production casing until a casing mandrel connected to a top end of the production casing is seated in a casing bowl of the wellhead;

cementing in the production casing;

removing the blowout preventer and drilling flange;

securing the casing mandrel to the wellhead using a second threaded union;

securing a tubing head spool to the casing mandrel using a third threaded union;

running in a production tubing until a tubing hanger is seated in the tubing head spool; and securing the tubing hanger to the tubing head spool using a fourth threaded union.

20. The method as claimed in claim 19 further comprising a step of securing an adapter flange to the tubing hanger using a fifth threaded union.

21. The method as claimed in claim 20 further comprising steps of:

after the step of securing the casing mandrel to the wellhead, securing a frac stack to the casing mandrel using a fifth threaded union, the frac stack having conduits for conveying proppants and pressurized fluids into the production casing for fracturing the subterranean hydrocarbon formation; and prior to the step of securing the tubing head spool to the casing mandrel, removing the frac stack from the casing mandrel.

22. The method as claimed in claim 20 further comprising securing flow control equipment to the adapter flange.

23. A wellhead system for stimulating and extracting subterranean hydrocarbons from a low-pressure well, the system comprising:

a conductor assembly installed above a subterranean hydrocarbon formation;

a first tubular head supported by the conductor assembly;

a first tubular string suspended in the well by threaded connection to a first mandrel;

a second tubular head supported by the first tubular head;

a second mandrel secured to the second tubular head by a threaded union; and a second tubular string suspended in the well by threaded connection to the second mandrel.

24. The wellhead system as claimed in claim 23 wherein the second tubular head is secured to the first mandrel by a threaded union.

* * * * *